United States Patent [19]

Anderson et al.

[11] Patent Number: 4,627,214

[45] Date of Patent: Dec. 9, 1986

[54] SLITTING-SCORING MACHINE

[75] Inventors: Leland J. Anderson, Catawba; James K. Jourdan; Carl R. Marschke, both of Phillips, all of Wis.

[73] Assignee: Marquip, Inc., Phillips, Wis.

[21] Appl. No.: 779,153

[22] Filed: Sep. 23, 1985

[51] Int. Cl.[4] ..... B26D 9/00

[52] U.S. Cl. ..... 83/71; 83/499

[58] Field of Search ..... 83/71, 498, 499, 503, 83/508.2, 508.3, 171, 16, 863, 864; 493/60

[56] References Cited

U.S. PATENT DOCUMENTS

| | | | |
|---|---|---|---|
| 3,540,340 | 3/1968 | Koskela | 83/499 |
| 3,651,723 | 3/1972 | Gallagher, Jr. et al. | 83/71 X |
| 4,070,890 | 1/1978 | Stubbings | 83/71 X |
| 4,224,847 | 9/1980 | Tokuno | 83/71 |
| 4,257,299 | 3/1981 | Aykut | 83/499 X |

FOREIGN PATENT DOCUMENTS 0078429 10/1982 European Pat. Off. .

*Primary Examiner*—Horace M. Culver

*Attorney, Agent, or Firm*—Andrus, Sceales, Starke & Sawall

[57] ABSTRACT

A machine frame mounts a pair of upper and lower girder-like box beams (10,11) of heavy construction. A plurality of upstream upper scoring assemblies (28) and a plurality of downstream upper slitting assemblies (30) are mounted on the upper box beam. The lower box beam (11) also supports a plurality of upstream lower scoring assemblies (29) and a plurality of downstream lower slitting assemblies (31). The assemblies include rotatably driven slitting or scoring blades (32, 33). The box beams extend transversely of a traveling web (2). The assemblies include a motor (50) connected to be driven along its beam, and an encoder (52), with all of the motors and encoders being electrically connected to a programmable computer (54). The computer may be pre-programmed with the position and spacing of all of the assemblies, so that upon the provision of a single input signal all of the motors simultaneously drive all of the assemblies to their desired position. A bearing block (59) is engageable by an elongated cam rod (62, 63) extending along the beam. Rotation of the rod causes simultaneous locking of all assemblies in an array in position along the beam. Adjusting the caliper between opposing scoring blades is accomplished by mounting the upper box beam (10) so that it is pivotable by an actuator (80) upwardly about the axis (89) of the rotatably driven shaft (35) for the upper slitting assembly blades. The temperature of the box beams (10, 11) is internally stabilized by heating.

16 Claims, 10 Drawing Figures

3
80
89
41
46
39
48
47
1
4
16
42
22
10
8
9
64
35
31
12
13
30
18
11
2
50
51
5
19
24
25
23
76
17
67a
43
66
75
6
74
77
78
67
73
72
70
71

SLITTING-SCORING MACHINE

BACKGROUND AND SUMMARY OF THE INVENTION

This invention relates to a slitting-scoring machine for traveling webs of corrugated cardboard which are ultimately formed into cardboard boxes. A representative machine of this type is disclosed in European Patent Publication No. 0 078 429 published on Oct. 15, 1982. Such machines usually include at least one scoring section for scoring longitudinal lines in the web, and at least one slitting section for appropriately longitudinally slitting the web so that it may ultimately be folded into box shape. Each section includes upper and lower scoring or slitting blades, as the case may be, which engage the web in an opposed manner for performing the desired function. In each section, a plurality of upper blades are arrayed in adjustably spaced relationship transversely across the web, with the lower blades being similarly arrayed.

Heretofore, most blades were mounted on very large solid rotatable shafts, with each blade being formed of a plurality of segments mounted around the outside of the shaft. It has been observed that this known construction had certain disadvantages in that the rotating shafts tended to deflect due to separating forces between tooling pairs. The preset distance between upper and lower opposed blades thereupon undesirably changed so that the scoring lines on the web were either too deep or shallow, and the cut ended up being ragged. There was no way to control this problem in the known construction.

In addition, in many prior known devices the blades on each shaft were adjusted therealong by a single external robot, which only moved one blade at a time into its desired position. In view of the fact that many scoring and cutting blades might be disposed on a given shaft, moving each blade individually on a given shaft resulted in an undesirably large amount of time being consumed to adjust all the blades on a single shaft.

Futhermore, the scoring and cutting blades in some prior devices known to the inventors were individually and separately locked to their respective shafts. This, also, was time consuming as well as being of costly construction.

The caliper or gap between opposed scoring blades is of substantial importance so that the score lines on the traveling web are of the correct thickness, as mentioned above. Adjustment of the caliper in known prior devices was also difficult, and tended to adversely affect slitting blade overlap.

It is an object of the present invention to essentially solve the aforementioned combination of problems occurring in the known prior slitting-scoring machines.

In accordance with the various aspects of the present invention, the machine frame mounts a pair of upper and lower girder-like box beams of heavy construction. The upper box beam is provided with a mounting means from which is suspended a plurality of upstream upper scoring assemblies and a plurality of downsteam upper slitting assemblies. The upper face of the lower box beam is also provided with a mounting means which supports a plurality of upstream lower scoring assemblies and a plurality of downstream lower slitting assemblies. The series of assemblies include circumferentially integral slitting or scoring blades, as the case may be, which are mounted for rotation with rotatably driven shafts of smaller diameter.

The box beams extend transversely of the traveling web, and each box beam is provided with upstream and downstream ways extending therealong which support the plurality of slitting-scoring assemblies. Besides the blades, the assemblies include a motor connected to be driven along its beam, and an encoder, with all of the motors and encoders being electrically connected to a programmable computer or the like. The computer may be pre-programmed with the desired position and spacing of all the assemblies, so that upon the push of a single button to create a single input signal all of the motors simultaneously drive all of the assemblies to their desired position.

Each of the slitting-scoring assemblies also carries a bearing block which is engageable by an elongated cam rod extending along the beam. There is a cam rod for each array of assemblies, and rotation of a rod causes simultaneous locking of all assemblies in its array in position along the beam.

The important function of adjusting the caliper or gap between opposing scoring blades is accomplished in the present embodiment by mounting the upper box beam so that it is pivotable upwardly about the rotatably driven shaft for the upper slitting assembly blades, which are downstream of the scoring blades. An actuator is suitably controlled to pivot the upper beam, which thereby raises or lowers the upper scoring blades relative to the fixed lower scoring blades. By adjusting the caliper of the scoring blades independently of the slitting blade overlap, the overlap may be kept at a minimum, which increases slitting blade life and improves slit quality.

Temperature gradients within the device may undesirably affect the dimensional stability of the machine. This is especially true of the box beams and the mounting and drive connections for the slitting-scoring assemblies. Any change in length or shape of these elements could cause the actual spacing of the assemblies to vary from the desire spacing. The problem is essentially solved by internally stabilizing the temperature of the box beams. In the present embodiment, the beams are sealed and thermostatically controlled fluid passes therethrough.

BRIEF DESCRIPTION OF THE DRAWINGS

The accompanying drawings illustrate the best mode presently contemplated by the inventors for carrying out the invention.

In the drawings.

DESCRIPTION OF THE PREFERRED EMBODIMENT

Figure 10:
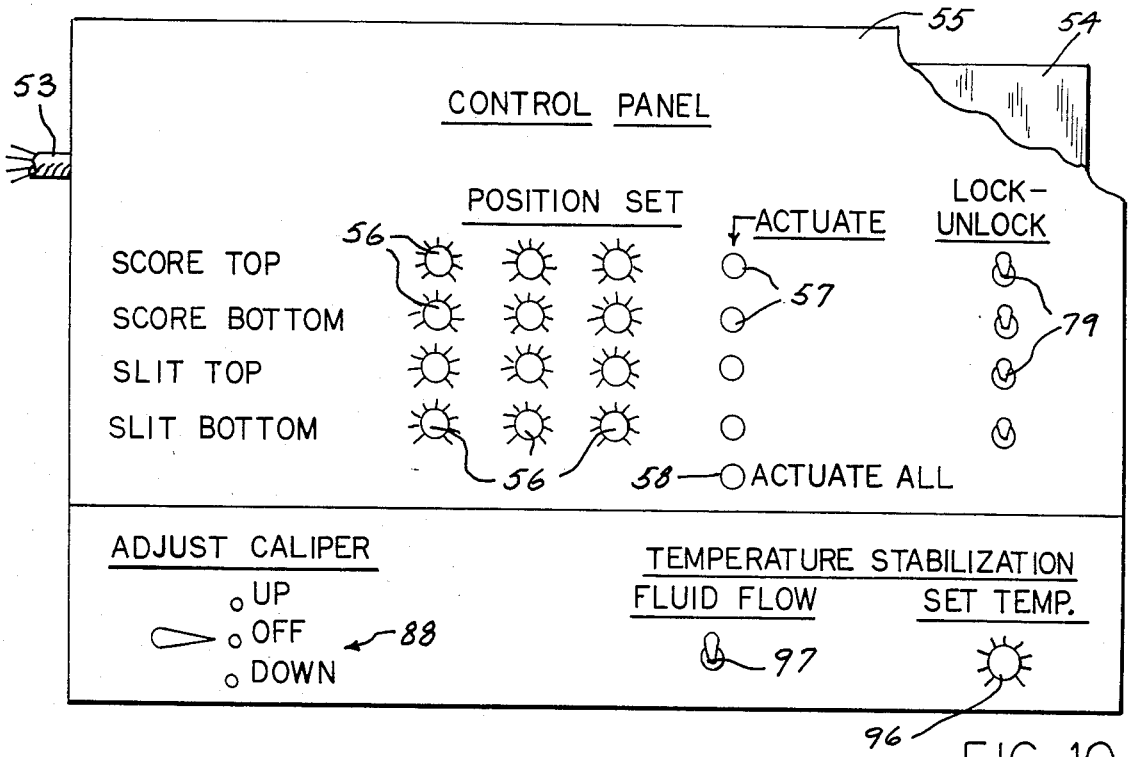
FIG. 10 is a showing of a control panel for some of the various functions of the machine, and incorporating the programmable computer.
Figure 1:
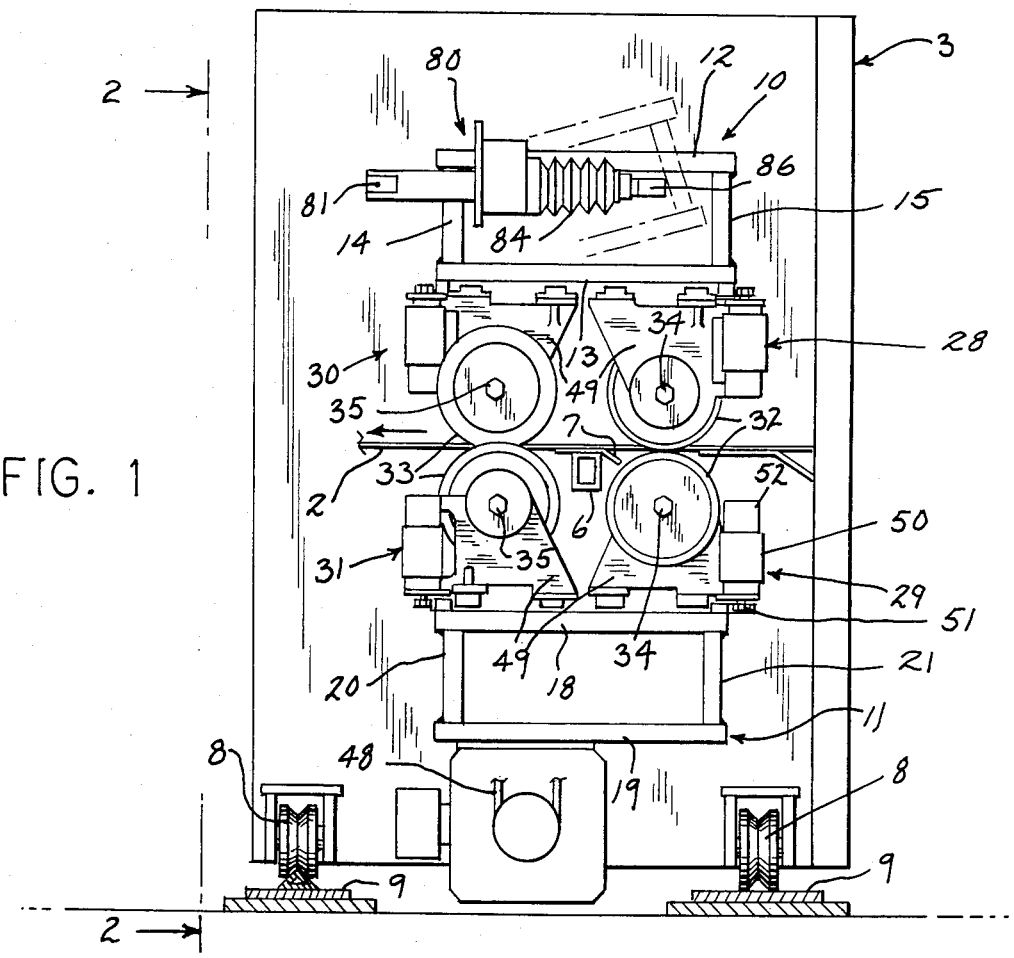
FIG. 1 is a schematic end elevation of a slitting-scoring machine constructed in accordance with the various aspects of the invention.
Figure 2:
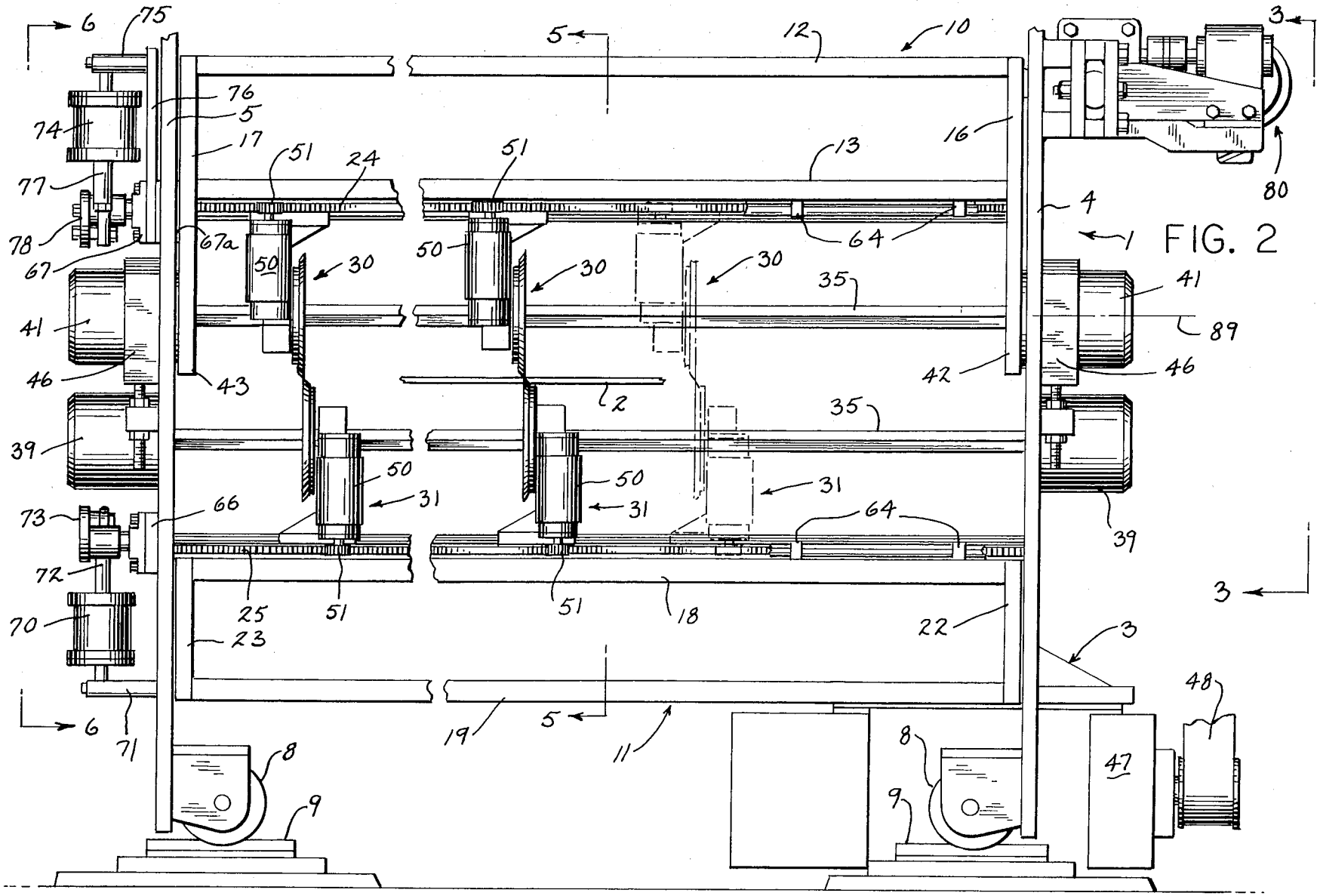
FIG. 2 is a view taken on line 2—2 of FIG. 1 with parts removed for purposes of clarity.
Figure 3:
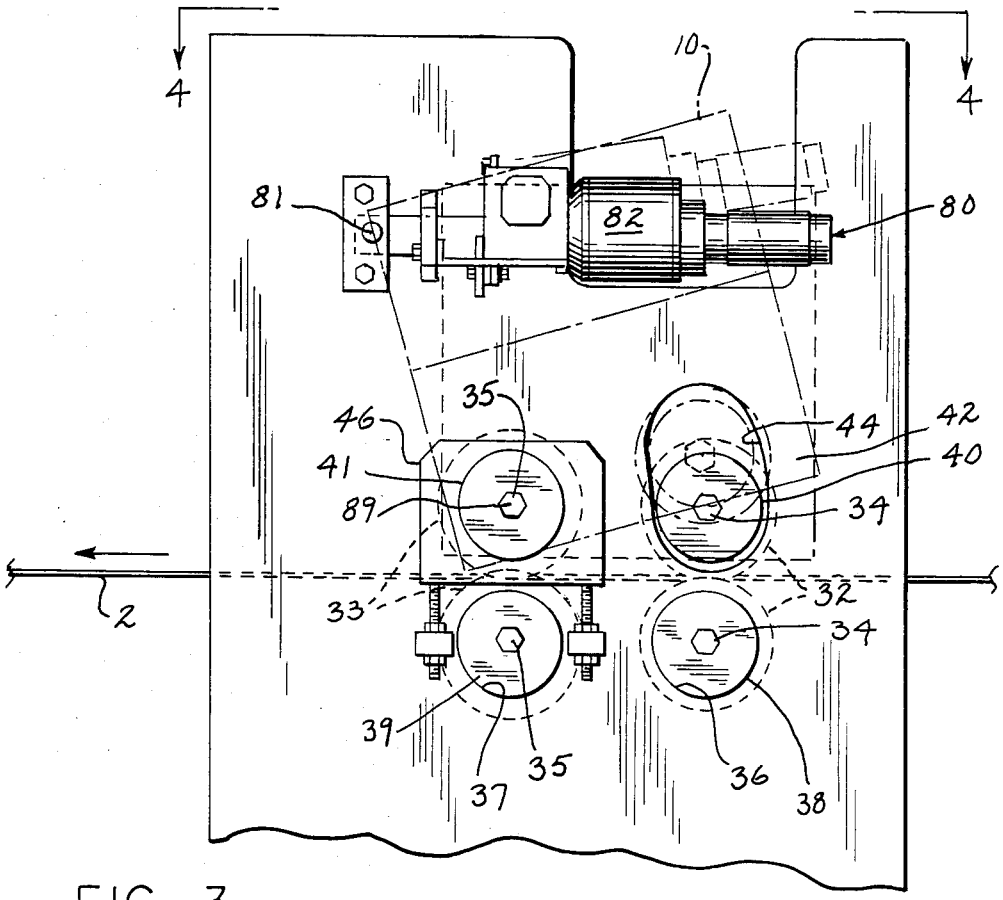
FIG. 3 is a view taken along line 3—3 of FIG. 2 and showing the caliper adjustment of the scoring blades.
Figure 4:
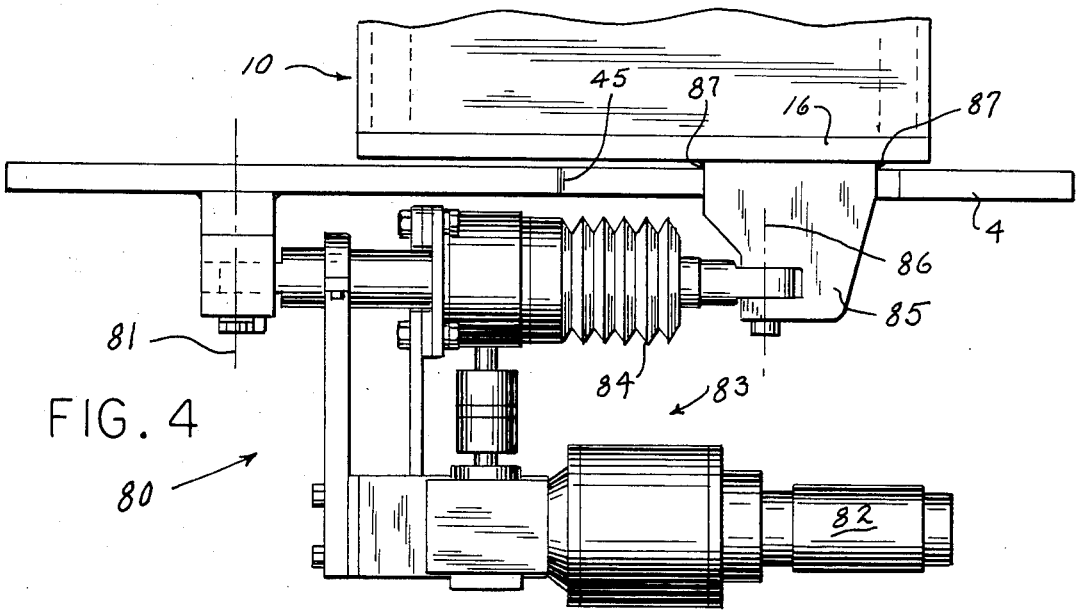
FIG. 4 is a top plan view taken on line 4—4 of FIG. 3.

As shown in the drawings, the slitting-scoring machine 1 of the invention is adapted to process a web 2 of cardboard or the like which travels in a direction shown by the arrows from an upstream source to a downstream further processing device, not shown. Machine 1 is disposed to extend transversely across web 2 and includes a frame 3 which comprises a pair of transversely spaced end members 4, 5 joined by various other elements including, for example, a central strut 6 which may be associated with suitable web guides 7. Frame 3 is shown as also including wheels 8 which are supported on tracks 9 so that the machine may be adjusted transversely of web 2 when needed.

Machine 1 is designed to score and slit the traveling web 2 longitudinally for subsequent formation thereof into a cardboard box. For this purpose, a pair of box beams 10, 11 are provided, with upper beam 10 being disposed above and spaced from web 2 and lower beam 11 being disposed below and spaced from web 2. Each beam 10, 11 extends transversely of web 2 and is of rigid heavy metal construction. Upper beam 10 comprises an enclosed assembly having a top wall 12, a bottom wall 13, side walls 14, 15 joining the top and bottom walls, and end walls 16, 17. The entire box beam 10 is welded together into a unified structure. Lower beam 11 is similarly constructed and includes a top wall 18, a bottom wall 19, side walls 20, 21 joining the top and bottom walls, and end walls 22, 23.

Box beams 10, 11 are adapted to rigidly carry the mechanism for slitting and scoring web 2. For this purpose, transverse enlongated gear racks 24 extend along each of the upstream and downstream edge portions of bottom wall 13 of upper box beam 10, and are secured thereto as by welding or bolting. Likewise, gear racks 25 are secured to and extend along the upstream and downstream edge portions of lower box beam 11. In addition, a plurality of linear bearings 26, 27 are secured to the exposed outer faces of walls 13 and 18 respectively.

Upstream rack 24 and its adjacent bearings 26 are associated with a plurality of transversely spaced upper scoring assemblies 28 which are suspended downwardly from box beam 10, while upstream rack 25 and bearings 27 are associated with a similar plurality of upwardly extending lower scoring assemblies 29. Likewise, downstream rack 24 and its adjacent bearings 26 are associated with a plurality of transversely spaced upper slitting assemblies 30 which are suspended from beam 10, while downstream rack 25 and bearings 27 are associated with a similar plurality of upwardly extending lower slitting assemblies 31.

Each assembly 28–31 is substantially identical, with the exception that the pair of upstream scoring assemblies 28 and 29 are provided with scoring blades 32, while the pair of downstream slitting assemblies 30 and 31 are provided with slitting blades 33. As can best be seen in FIG. 5, opposed scoring blades 32 are adapted to linearly squeeze web 2 to provide a score line therein, while opposed slitting blades 33 are adapted to overlap to actually slit the web longitudinally along its path of movement.

Scoring blades 32 are mounted for sliding movement on and rotation with a pair of upstream upper and lower hex-shafts 34, while slitting blades 33 are similarly mounted on a pair of downstream upper and lower hex-shafts 35. Because of the inventive concepts utilized in the machine, hex-shafts 34 and 35 may be of much less massive construction and of lesser diameter than the prior known blade support shafts. This also facilitates use of circumferentially integral blades.

Referring particularly to FIGS. 2, 3, 5 and 8, lower upstream and downstream hex-shafts 34 and 35 are coextensive with box beam 11 and extend through respective upstream and downstream circular openings 36 and 37 in the respective frame end members 4 and 5 where they are journalled in lower upstream and downstream journals 38 and 39 which are fixedly mounted to end members 4 and 5. However, upper upstream and downstream hex-shafts 34 and 35 are adapted for movement in a vertical plane, as will be described. Referring to the above figures of the drawings, and also FIG. 6, the ends of upper upstream and downstream hex-shafts 34 and 35 are also journalled in journals 40 and 41 respectively, but these latter journals are fixedly mounted to downward extensions 42, 43 of box beam end walls 16 and 17. Journals 40 and 41 extend through non-circular openings 44 and 45 disposed in end members 4 and 5.

Vertical adjustment of journals 41, and thus upper downstream hex-shaft 35, is accomplished by pillow blocks 46 of any conventional well-known type which are mounted to extensions 42 and 43 and suitably connected to the journals.

The pairs of hex-shafts 34 and 35, and thus the respective scoring and slitting blades 32 and 33, are rotatably driven by any suitable well-known mechanism, which may include a motor 47, drive belt 48, and other conventional mechanism, not shown.

Figure 5:
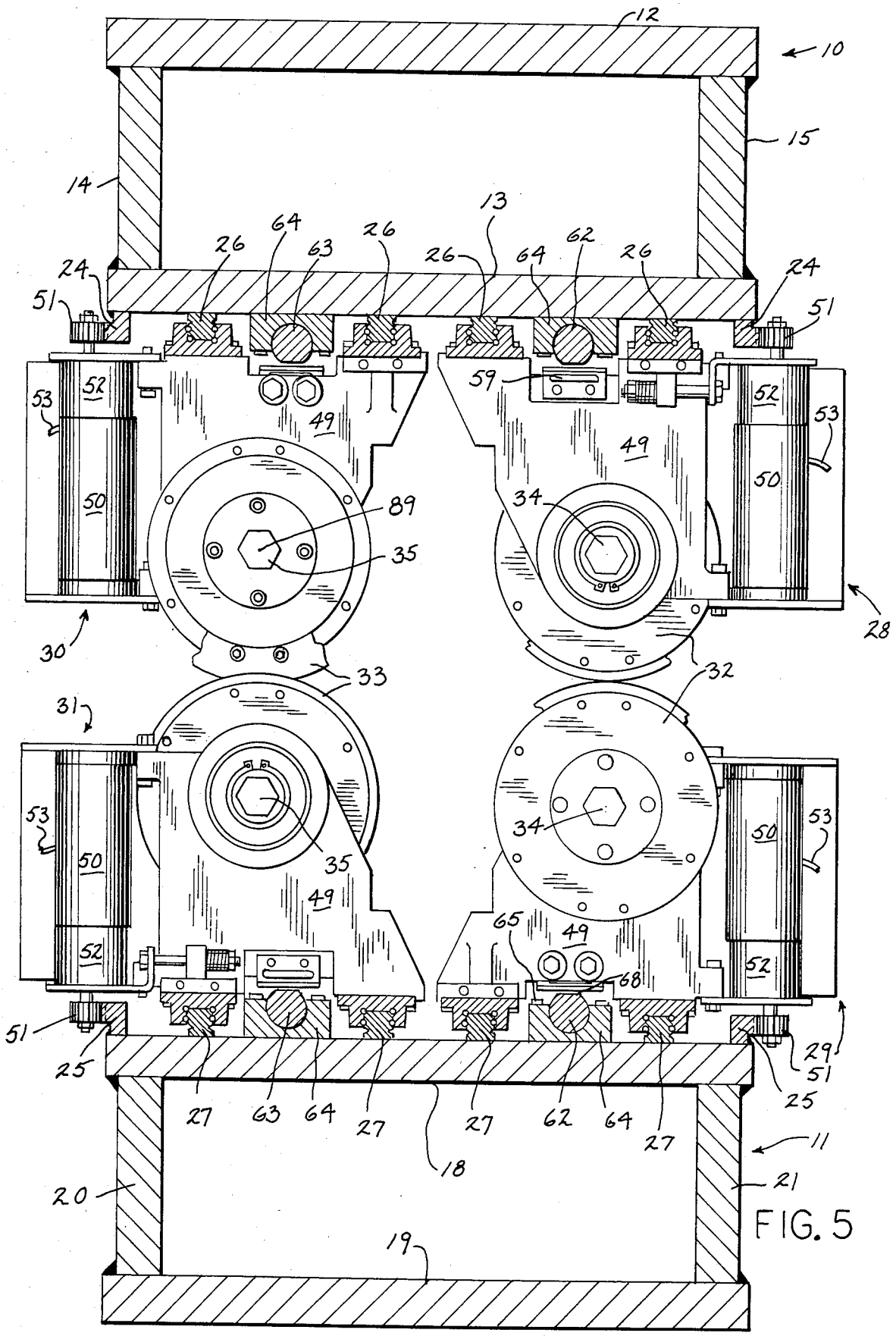
FIG. 5 is an enlarged vertical section taken on line 5—5 of FIG. 2.

Returning to the construction of scoring and slitting assemblies 28–31, and referring particularly to FIG. 5, each of the assemblies includes a frame 49 which carries a blade 32 or 33 and which is either suspended from or extends upwardly from the respective box beam 10 or 11. Each assembly frame is mounted for movement along the respective linear bearings 26 or 27. Furthermore, a motor 50 is mounted to frame 49 and has an output shaft carrying a pinion 51 which meshes with either upper or lower racks 24 or 25, as the case may be. An encoder 52 is suitably connected to each motor in the usual manner for purposes of sensing the exact position of each of the plurality of assemblies 28–31 along the longitudinal extent of each box beam 10, 11.

In accordance with one of the aspects of the invention, control means are provided to automatically shift each of the scoring and slitting assemblies 28–31 along its respective mounting shaft 34, 35 so that different score and slit lines can be made for different size or shape box patterns. For this purpose, and in the embodiment shown, each combination of a motor 50 and encoder 52 is connected through suitable wiring 53 to a control unit 54 (see FIG. 10) which may comprise any suitable programmable control, such as a computerized numerical control (CNC) of any well-known type. The front panel 55 of control unit 54 includes manually actuatable devices for pre-setting the position of each assembly 28–31 on its respective shaft and for causing the assemblies to move to a desired position. Assembly position adjustment knobs 56 are provided for each slitting and scoring assembly, with knobs 56 being arranged into groups, one group for each transverse array of assemblies. The knob settings are fed to the CNC computer and, when the assembly blades are to be repositioned, an "Actuate" button 57 may be pushed for any individual assembly array. This causes the computer to actuate all of the motors 50 in a given assembly array to rotate the respective pinions 51 on their racks 24, 25 in accordance with the instructions provided at the control panel 55, and taking the output of the encoders 52 into account, to simultaneously reposition all of the blades 32 or 33 in that particular array.

Each of the four "Actuate" buttons shown in FIG. 10 can be pushed individually to re-set each array separately at different times. However, means are also provided to re-set all of the blades in all of the arrays simultaneously. Pushing an "Actuate All" button 58 will interconnect all of the actuating circuitry to accomplish this function.

Machine 1 also includes a unique means for locking slitting and scoring assemblies 28–31 in place relative to racks 24, 25 and box beams 10, 11 once the assemblies have been suitably positioned. For this purpose, and referring especially to FIGS. 2, 3 and 5–7, a bearing block 59 having a flat horizontal wear plate surface 60 thereon is mounted within a recess 61 in each assembly frame 49. Bearing blocks 59 are adapted to respectively cooperate with upstream and downstream cam shafts 62, 63 which are coextensive with box beams 10, 11 with one cam shaft for each array of slitting-scoring assemblies. The intermediate portions of cam shafts 62, 63 are cradled in bushings 64, spaced along the cam shafts and which are suitably secured to box beam walls 13 and 18, as by bolts 65.

The end portions of the upstream and downstream lower cam shafts 62, 63 extend through frame openings 36, 37 on the non-drive side of the machine, and are bearinged in journals 66 which are secured to the outer faces of frame end portions 4 and 5. The end portions of the corresponding upper cam shafts 62, 63 extend through extensions 42, 43 of plates 16 and 17 on the non-drive side of the machine. The shafts are journalled at bearings 67 by means of spacer **67*a*. Bearings 67 are mounted on plate 76**.

Cam shafts 62, 63 are generally circular and are each provided with a flat 68 which is coextensive with the shaft length. When assemblies 28–31 are to be shifted along their respective beams, shafts 62, 63 are positioned so that flats 68 are out of engagement with and generally parallel to wear plate surfaces 60. Once assemblies 28–31 are in position to perform their tasks, cam shafts 62, 63 are rotated so that the round portion of the cam shafts lockingly engage surfaces 60. See FIG. 7.

Figure 6:
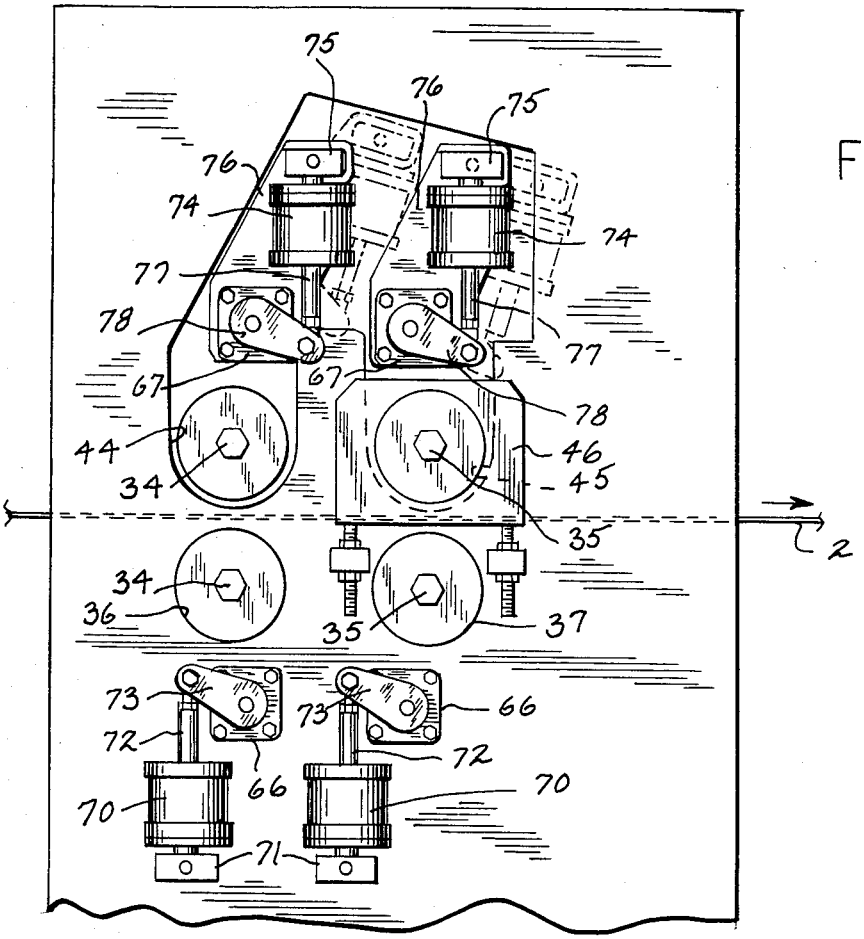
FIG. 6 is a view taken on line 6—6 of FIG. 2.
Figure 7:
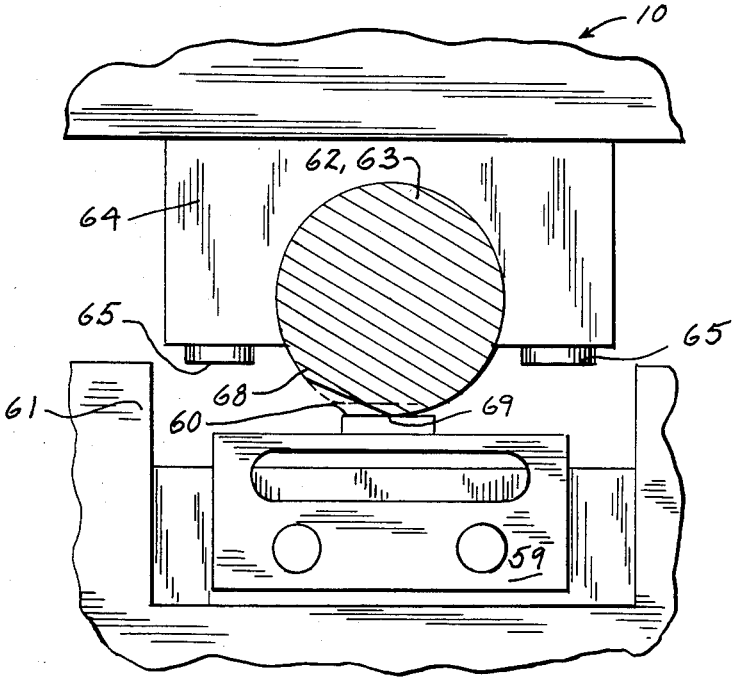
FIG. 7 is an enlarged view, partly in section, illustrating the assembly locking device.

In the present embodiment, cam shafts 62, 63 are rotated by motive means. Referring to FIGS. 6 and 7, and for each lower cam shaft 62, 63, a pneumatic cylinder 70 is fixedly mounted at one end to a bracket 71 which extends outwardly from the lower portion of frame end portion 5. The output shaft 72 of cylinder 70 is connected through a crank mechanism 73 to the respective lower cam shaft. For each upper cam shaft 62, 63, a pneumatic cylinder 74 is fixedly mounted at one end through a bracket 75 to a plate 76 which is disposed externally of and parallel to the outer upper face of extension 43. Plate 76 is fixedly secured to journal 67. The output shaft 77 of cylinder 74 is connected through a crank mechanism 78 to the respective upper cam shaft.

The cam actuator cylinders 70 and 74 may be controlled and operated by any well-known mechanism. In FIG. 10, control panel 55 is shown as having toggle switches 79 for controlling the locking or unlocking of the slitting-scoring assemblies 28–31 to their respective cam shafts by controlling the appropriate cam actuating cylinder.

The construction is such that each cam shaft 62, 63 functions to lock or unlock all of the slitting or scoring assemblies in its adjacent array, no matter where the assemblies are positioned therealong. The assemblies may be adjusted any number of times in an infinite number of relative positions without having to make any change in the cam locking mechanism.

It is important in devices for scoring cardboard or the like that the spacing between opposed scoring blades, such as 32 herein, can be adjusted for different thicknesses and types of web material. The opposed score lines should be sufficient to permit easy subsequent bending of the material, but without cutting through the material itself. One of the aspects of the present invention is to provide means for adjusting the relative spacing of the opposed scoring blades 32, even though the blades are mounted to heavy girder box beams 10 and 11.

For this purpose, and referring to FIGS. 1–4 and 6, a device is provided to pivot at least one box beam 10, 11. In the present embodiment, the upstream portion of upper box beam 10 (which carries the upstream top scoring blades 32) pivots upwardly, with beam 10 pivoting about the downstream upper hex-shaft 35. As shown, a linear actuator 80 which is basically in the form of a screw jack, is mounted at one end to the outer face of frame end portion 4 for pivotal movement about a transverse axis 81. Linear actuator 80 is shown to include a motive drive device such as a reversible motor 82 which connects through a suitable coupling, brake and gear reducer assembly 83 to rotatably drive a screw shaft 84 to extend or retract the latter. The outer end of shaft 84 is mounted to a bracket 85 for pivotal movement about a further transverse axis 86. Bracket 85 in turn extends through a rectangular opening **86*a* (FIG. 8) in frame end portion 4, said opening (and its matching opening in frame end portion 5) being elongated slightly in a vertical direction. Furthermore, the inner end of bracket 85 is fixedly mounted to the outer face of the upstream portion of end wall 16 of box beam 10, as by welds 87**.

Motor 82 is shown as being actuatable in either direction to extend or retract linear actuator 80 by means of an "Adjust Caliper" switch 88 disposed on control panel 55. Actuation of motor 82 causes bracket 85 to swing the upstream portion of box beam 10 either upwardly or downwardly. In view of the fact that the end extensions 42 and 43 of box beam 10 are mounted on front journals 41 for upper hex-shaft 35, box beam 10 thus pivots about the shaft's axis 89 to adjust the spacing between the opposed upstream scoring blades 32.

The massive structure of machine 1 is such that temperature gradients across box beams 10 and 11 may cause the beams and racks 24 and 25 carried thereby, to vary in length and flatness. At this point in its manufacture, the web 2 of corrugated board or the like is very hot. As web 2 passes between the pairs of scoring and slitting blades, it actually heats beam walls 13 and 18 to a higher temperature than beam walls 12 and 19, which are more remote. Due to the coefficient of expansion of steel, the tubular structure of beams 10 and 11 will tend to distort into a banana shape, which causes loss of control of slitting and score depth settings. Furthermore, as the entire beam structure expands, rack 24 and 25 will also expand, causing positional errors. Such distortions are undesirable and result in incorrect or ragged scoring and/or slitting lines. An aspect of the invention solves this problem so that the dimensions of the box beams and racks remain essentially constant, regardless of temperature gradients.

Figure 8:
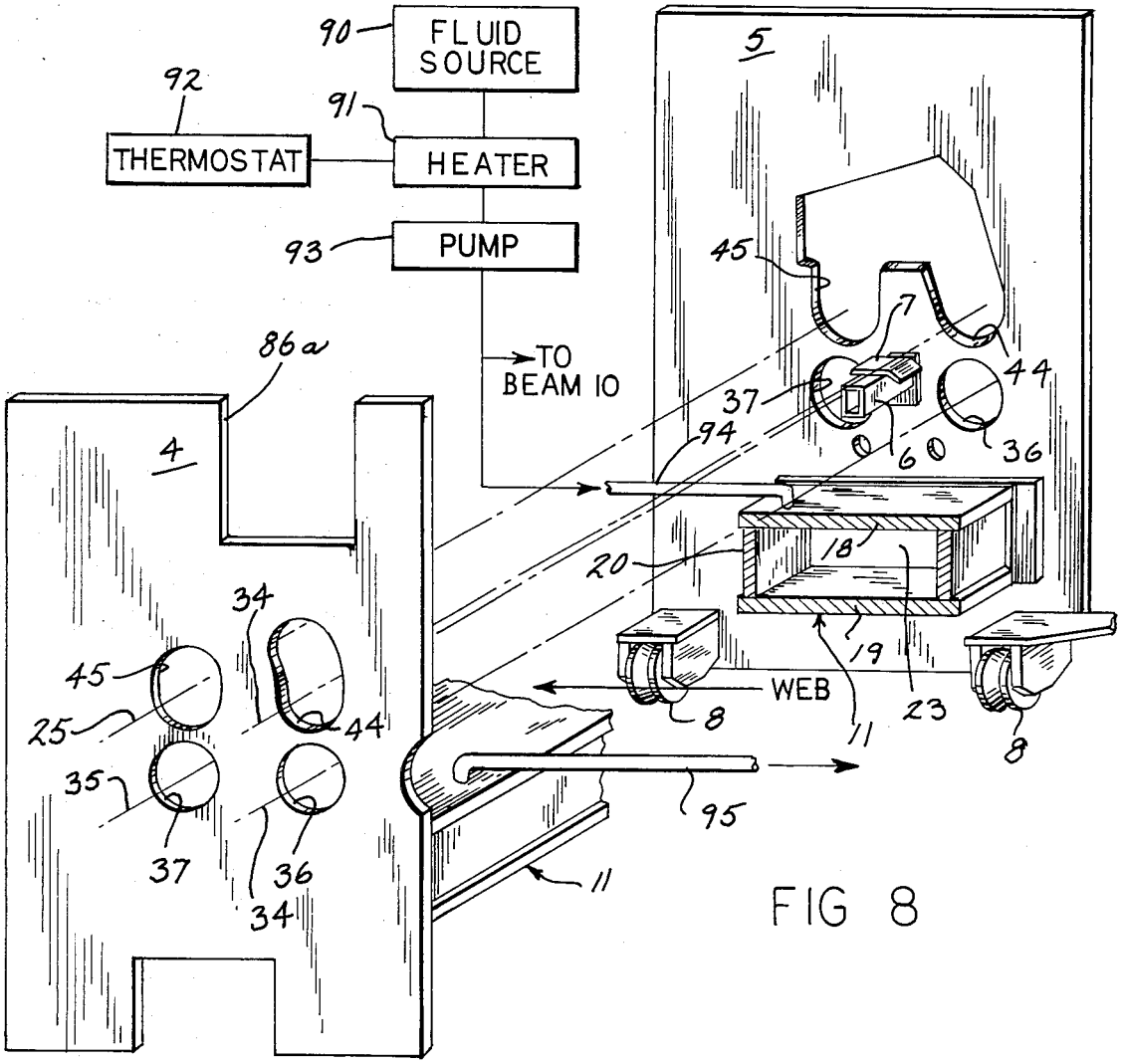
FIG. 8 is a perspective view of portions of the machine frame, and illustrating the stabilization of box beam temperature.
Figure 9:
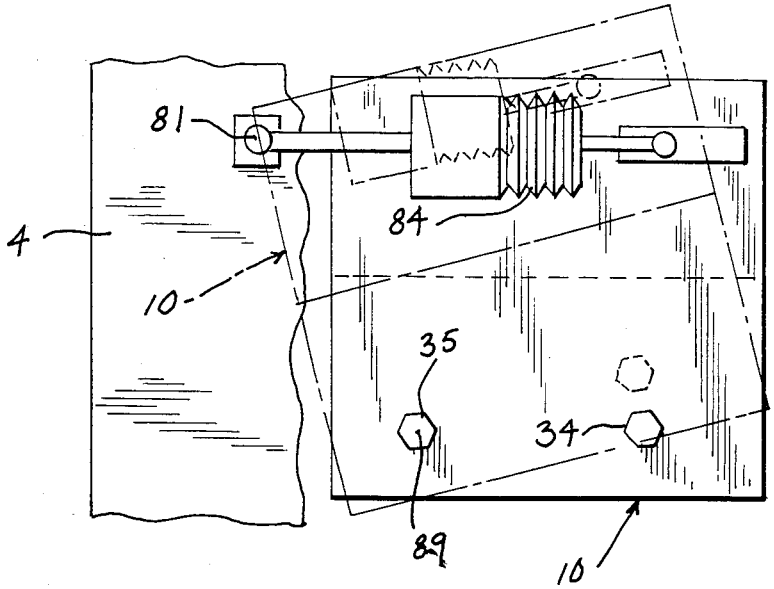
FIG. 9 is a further schematic view of the caliper adjustment device.

For this purpose, box beams 10 and 11 are constructed to be fluid tight and thereby provide sealed internal chambers. FIG. 8 illustrates the inventive concept wherein a fluid source 90 has an output connected to a heater 91 which in turn is actuated by a thermostat 92 which is set to a temperature which is at least as high or higher than any ambient temperature to which the beams are subjected. An adequate setting may be about 110°. Heated fluid discharged from heater 91 passes through a pump 93 and hence through an inlet conduit 94 disposed to discharge the fluid into one end of box beam 11. The fluid flows down the length of the internal beam chamber and ultimately exits through a discharge conduit 95, where it may be recirculated or passed to drain. Similar inlet and discharge conduits 94 and 95 would of course be connected to box beam 10. If desired, both box beams 10 and 11 could be connected together in a closed fluid recirculating system including primarily only a pump and heater-thermostat.

The operation may be suitably controlled from panel 55 (FIG. 10), as by a "Set Temperature" dial 96 which is connected to thermostat 92, and a fluid flow On-Off switch 97 connected to pump 93.

Although only a few assemblies 28–31 are illustrated in the drawings, it is not uncommon for as many as 16 scoring tools and 9 slitting tools to be positioned along a given respective shaft 34, 35 so that a many as 8 boxes can be developed at once. When web 2 discharges from machine 1, a downstream machine, not shown, may sense the web's movement and score and slit it transversely to create the complete box.

The various aspects of the invention provide substantial improvements over previously known slitting-scoring machines. The provision of massive upper and lower box beams which support the blade carrying assemblies provides a much more rigid mounting structure than has been possible with rotating shafts. Structural deflections of pairs of blades caused by separation forces arising from slitting and scoring the web, are substantially reduced. Likewise, the provision of adjustably movable computer controlled blade-carrying assemblies, each of which carries its own motive means and position sensing encoder, permits fast simultaneous positional adjustment of all the assemblies on a given shaft or on all shafts. Furthermore, the device for pivotally adjusting a box beam about one of the slitting blade support shafts provides an effective means for adjusting the caliper of opposing scoring blades without affecting the overlap of the slitting blades. Finally, temperature caused caliper setting variations of the slitting-scoring blades is substantially eliminated by thermally stabilizing the box beams.

Various modes of carrying out the invention are contemplated as being within the scope of the following claims particularly pointing out and distinctly claiming the subject matter which is regarded as the invention.

We claim:

1. A machine for slitting and scoring a web of longitudinally traveling cardboard or the like along the upstream-to-downstream direction of web travel, comprising, in combination:

(a) a frame (4,5), (b) an upper and a lower heavy box beam (10, 11) connected to said frame and adapted to extend transversely across a web (2) with the web disposed between said beams, (c) longitudinally spaced transversely extending rotatable shafts (34, 35) connected to each said upper and lower box beam (10, 11) and forming pairs of upstream and downstream shafts, (d) a plurality of generally opposed web scoring blades (32) mounted on one of said pairs of shafts for rotation therewith, (e) a plurality of generally opposed web slitting blades (33) mounted on the other of said pairs of shafts for rotation therewith, (f) scoring and slitting assemblies (28–31) associated with each said respective blade (32, 33), (g) and means (26, 27) mounting said assemblies to said upper and lower box beams.

2. The machine of claim 1 in which:

(a) said upper box beam (10) comprises top and bottom walls (12, 13) joined by upstream and downstream side walls (14, 15), and end walls (16, 17), (b) said lower box beam (11) comprises top and bottom walls (18, 19) joined by upstream and downstream side walls (20, 21), and end walls (22, 23), (c) and said assemblies are mounted to said bottom wall (13) of said upper box beam (10) and to said top wall (18) of said lower box beam (11).

3. The machine of claim 1 or 2:

(a) in which a plurality of said blades are disposed on each said shaft (34, 35) to form a respective transversely extending array of scoring or slitting blades (32, 33), (b) motive means (50) disposed on said assemblies (28–31) and drivingly connected to said box beams (10, 11), (c) blade position sensing means (52) disposed on said assemblies, (d) and programmable control means (54, 55) for actuating said motive means in accordance with the output of said sensing means to selectively move said blades along their respective shafts to thereby adjust for differing slitting and scoring patterns.

4. The machine of claim 3 in which said programmable control means (54, 55) functions to move all of said blades in a given said array of blades simultaneously.

5. The machine of claim 3 in which said programmable control means (54, 55) functions to move all of said blades in all of said arrays simultaneously.

6. The machine of claim 3 in which said driving connection between said motive means (50) and said box beams (10, 11) comprises:

(a) elongated transversely extending racks (24, 25) secured to and coextensive with said box beams, (b) and rotatable pinions (51) on said motive means and meshing with said racks for travel therealong.

7. The machine of claim 3 which includes locking means (59–79) to selectively lock said assemblies (28–31) and their respective scoring and slitting blades (32, 33) at any transverse position along said shafts (34, 35).

8. The machine of claim 7 in which said locking means comprises:

(a) engagement surfaces (60) formed on said assemblies, (b) transversely extending cam shafts (62, 63) coextensive with said box beams (10, 11) with one cam shaft for each said transverse array of blades (32, 33), (c) said cam shafts including flats (68) and round portions coextensive with the cam shaft length, (d) and means for rotating said cam shafts so that said round portions selectively and simultaneously lockingly engage said surfaces (60).

9. The machine of claim 3:

(a) in which said scoring blades (32) are disposed in normally opposing upper and lower relationship on one of said pair of shafts (34), (b) and adjustment means including at least one of said box beams (10, 11) for adjusting the caliper between upper and lower scoring blades (32) independently of said slitting blades (33).

10. The machine of claim 9:

(a) in which said upper box beam (10) is mounted for pivotal movement about the axis (89) of the upper shaft of the other said pair of shafts (35), (b) and motive means (80) to tilt said upper box beam (10) about said axis (89) so that the spacing between said normally opposing scoring blades (32) is adjusted.

11. The machine of claim 3:

(a) in which said box beams (10, 11) are normally subject to ambient temperature gradients causing distortion of said box beams and the driving connection (24–25, 51) between said motive means (50) and said box beams (10, 11), (b) and means (90–95) for thermally stabilizing said box beams so that they and said driving connection are essentially unaffected by ambient temperature gradients.

12. The machine of claim 3 in which:

(a) said box beams (10, 11) are fluid tight and providing sealed internal chambers, (b) and said thermally stabilizing means comprises:

(1) thermostatically controlled heating means (91) for heating a supply of fluid to a temperature at least as high as any ambient temperature expected to affect said beams, (2) and means (93–95) for flowing said heated fluid through said internal chambers of said box beams (10, 11).

13. A machine for slitting and scoring a web of longitudinally traveling cardboard or the like along the upstream-to-downstream direction of web travel, comprising, in combination:

(a) a frame (4,5), (b) upper and lower support means (10, 11) connected to said frame and adapted to extend transversely across a web (2) with the web disposed between said support means, (c) longitudinally spaced transversely extending rotatable shafts (34, 35) connected to each said upper and lower support means and forming pairs of upstream and downstream shafts, (d) a plurality of generally opposed web scoring blades (32) mounted on one of said pairs of shafts for rotation therewith, (e) a plurality of generally opposed web slitting blades (33) mounted on the other of said pairs of shafts for rotation therewith, (f) scoring and slitting assemblies (28–31) associated with each said respective blade (32, 33), (g) means (26, 27) mounting said assemblies to said upper and lower support means, (h) a plurality of said blades being disposed on each said shaft (34, 35) to form a respective transversely extending array of scoring or slitting blades (32, 33), (i) motive means (50) disposed on said assemblies (28–31) and drivingly connected to said support means (10, 11), (j) blade position sensing means (52) disposed on said assemblies, (k) and programmable control means (54, 55) for actuating said motive means in accordance with the output of said sensing means to selectively move said blades simultaneously along their respective shafts to thereby adjust for differing slitting and scoring patterns.

14. A machine for slitting and scoring a web of longitudinally traveling cardboard or the like along the upstream-to-downstream direction of web travel, comprising, in combination:

(a) a frame (4,5), (b) upper and lower support means (10, 11) connected to said frame and adapted to extend transversely across a web (2) with the web disposed between said support means, (c) longitudinally spaced transversely extending rotatable shafts (34, 35) connected to each said upper and lower support means and forming pairs of upstream and downstream shafts, (d) a plurality of generally opposed web scoring blades (32) mounted on one of said pairs of shafts for rotation therewith, (e) a plurality of generally opposed web slitting blades (33) mounted on the other of said pairs of shafts for rotation therewith, (f) scoring and slitting assemblies (28–31) associated with each said respective blade (32, 33), (g) means (26, 27) mounting said assemblies to said upper and lower support means, (h) locking means (59–79) to selective lock said assemblies (28–31) and their respective scoring and slitting blades (32, 33) at any transverse position along said shafts (34, 35), said locking means comprising:

(1) engagement surfaces (60) formed on said assemblies, (2) transversely extending cam shafts (62, 63) coextensive with said support means (10, 11) with one cam shaft for each said transverse array of blades (32, 33), (3) said cam shafts including flats (68) and round portions coextensive with the cam shaft length, (4) and means for rotating said cam shafts so that said round portions selectively and simultaneously lockingly engage said surface (60).

15. A machine for slitting and scoring a web of longitudinally traveling cardboard or the like along the upstream-to-downstream direction of web travel, comprising, in combination:

(a) a frame (4,5), (b) upper and lower support means (10, 11) connected to said frame and adapted to extend transversely across a web (2) with the web disposed between said support means, (c) longitudinally spaced transversely extending rotatable shafts (34, 35) connected to each said upper and lower support means and forming pairs of upstream and downstream shafts, (d) a plurality of generally opposed web scoring blades (32) mounted on one of said pairs of shafts for rotation therewith, (e) a plurality of generally opposed web slitting blades (33) mounted on the other of said pairs of shafts for rotation therewith, (f) scoring and slitting assemblies (28–31) associated with each said respective blade (32, 33), (g) means (26, 27) mounting said assemblies to said upper and lower support means, (h) said scoring blades (32) being disposed in normally opposing upper and lower relationship on one of said pair of shafts (34), (i) and adjustment means including at least one of said support means (10, 11) for adjusting the calpier between upper and lower scoring blades (32) independently of said slitting blades (33), (j) said upper support means (10) being mounted for pivotal movement about the axis (89) of the upper shaft of the other said pair of shafts (35), (k) said adjustment means including motive means (80) to tilt said upper support means (10) about said axis (89) so that the spacing between said normally opposing scoring blades (32) is adjusted.

16. A machine for slitting and scoring a web of longitudinally traveling cardboard or the like along the upstream-to-downstream direction of web travel, comprising, in combination:

(a) a frame (4,5), (b) an upper and a lower heavy box beam (10, 11) connected to said frame and adapted to extend transversely across a web (2) with the web disposed between said beams, (c) longitudinally spaced transversely extending rotatable shafts (34, 35) connected to each said upper and lower box beam (10, 11) and forming pairs of upstream and downstream shafts, (d) a plurality of generally opposed web scoring blades (32) mounted on one of said pairs of shafts for rotation therewith, (e) a plurality of generally opposed web slitting blades (33) mounted on the other of said pairs of shafts for rotation therewith, (f) scoring and slitting assemblies (28–31) associated with each said respective blade (32, 33), (g) means (26, 27) mounting said assemblies to said upper and lower box beams, (h) a plurality of said blades being disposed on each said shaft (34, 35) to form a respective transversely extending array of scoring or slitting blades (32, 33), (i) motive means (50) disposed on said assemblies (28–31) and drivingly connected to said box beams (10, 11), (j) said box beams being normally subject to temperature gradients causing distortion of said box beams and the driving connection (24–25, 51) between said motive means (50) and said box beams (10, 11), (k) said box beams (10, 11) being fluid tight and providing sealed internal chambers, (l) and means (90–95) for thermally stabilizing said box beams so that they and said driving connection are essentially unaffected by ambient temperature gradients, said last named means comprising:

(1) thermostatically controlled heating means (91) for heating a supply of fluid to a temperature at least as high as any ambient temperature expected to affect said beams, (2) and means (93–95) for flowing said heated fluid through said internal chambers of said box beams (10, 11).

* * * * *